US006047428A

United States Patent [19]

Min

[11] Patent Number: 6,047,428

[45] Date of Patent: Apr. 11, 2000

[54] METHOD FOR DETECTING AN UNBALANCED DRUM IN A DRUM TYPE WASHING MACHINE

[75] Inventor: Byung-kwon Min, Suwon, Rep. of Korea

[73] Assignee: Samsung Electronics Co., Ltd., Suwon, Rep. of Korea

[21] Appl. No.: 09/153,018

[22] Filed: Sep. 15, 1998

[30] Foreign Application Priority Data

Jul. 2, 1998 [KR] Rep. of Korea ..... 98-26510

[51] Int. Cl.[7] ..... D06F 33/02

[52] U.S. Cl. ..... 8/159; 68/12.06

[58] Field of Search ..... 8/159; 68/12.06; 34/319

[56] References Cited

U.S. PATENT DOCUMENTS 5,765,402 6/1998 Ikeda et al. ..... 68/12.06

5,906,020 5/1999 Swint ..... 68/12.06 X

FOREIGN PATENT DOCUMENTS 0523371 1/1993 European Pat. Off. ..... 68/12.06

4-90791 3/1992 Japan .

*Primary Examiner*—Philip R. Coe

*Attorney, Agent, or Firm*—Burns, Doane, Swecker & Mathis, L.L.P.

[57] ABSTRACT

Disclosed is a method for detecting an unbalanced drum in a drum type washing machine. In the method, deviation of the number of revolutions is calculated, and unbalance of the drum is judged when the deviation is greater than a predetermined unbalance criterion. The deviation is the difference between maximum and minimum numbers of revolutions. The calculation of deviation and the judgement of unbalance are repeatedly performed. Pulse signals of a tachometer need not be accumulated over a long period of time, and an additional unbalance detection program need not be provided and performed, whereby the unbalanced drum can be detected in a short period of time.

7 Claims, 4 Drawing Sheets

METHOD FOR DETECTING AN UNBALANCED DRUM IN A DRUM TYPE WASHING MACHINE

BACKGROUND OF THE INVENTION

1. Field of the Invention

The present invention relates to a method for detecting an unbalanced drum in a drum type washing machine, and more particularly, to a method for detecting whether a drum is unbalanced or not by checking for deviations in the number of revolutions of the drum.

2. Prior Art

FIG. 1 is a perspective view of a conventional drum type washing machine, and FIG. 2 is a schematic view of a device for detecting unbalanced drum in the drum type washing machine shown in FIG. 1. The drum type washing machine has a body 1, a tub 2 supported in the body 1 by a suspension and a shock absorber which are not shown, and a drum 3 installed in the tub 2 to be capable of rotating.

A driving motor 5 for driving the drum 3 is installed at one side of the tub 2, and a door 8 for opening/closing the tub 2 is installed on the front of the body 1. At the upper front area of the body 1, a control panel 10 is provided, through which a user controls the operation of the washing machine.

A power transmission 20 is provided in the rear of the tub 2. The power transmission 20 is comprised of pulleys 21 and 22 which are respectively assembled with the drum 3 and the driving motor 5, and a belt 23 for connecting the pulleys 21 and 22 with each other. As the driving motor 5 operates, the drum 3 is rotated through the power transmission 20. Meanwhile, the washing machine has a tachometer 50 for gauging the number of revolutions of the drum 3.

The operations of the washing machine consists of a washing operation, a rinsing operation, and a dehydrating operation. In order to perform the washing operation, the user opens the door 8 and puts laundry into the drum 3, and then utilizes the control panel 10. The control part 40 in the washing machine controls the operation of the washing machine according to the operation by the user.

In the washing operation, the laundry is washed while the drum 3 is rotated by the driving motor 5. That is, as the drum 3 is rotated, the laundry in the drum 3 is raised by the drum 3 and then is dropped. The washing operation of detergent is performed by the impact applied to the laundry in such a situation. The drum 3 is rotated in forward and reverse directions alternately.

Meanwhile, in the dehydrating operation, the driving motor 5 rotates the drum 3 in a high rotational velocity. The laundry is dehydrated by the centrifugal force generated by the rotating drum 3.

Since the drum 3 is rotated at a high rotational velocity during the dehydrating operation, vibrations of the drum 3 may occur. In particular, if the unbalance of the drum 3 caused by the uneven distribution of the laundry in the drum 3 occurs, the vibrations can become great. Such vibrations may cause a significant malfunction in the dehydrating operation, and the operation of the washing machine can be stopped if the vibrations are excessive. Therefore, the washing machine detects the unbalanced drum 3, and performs a balancing operation if an unbalanced drum 3 is detected.

FIG. 3 shows a conventional method for detecting an unbalanced drum.

At first, the tachometer 50 detects S101 pulse signals such as pulse width or pulse period according to the rotation of the driving motor 5. The detection of the pulse signals is continued S102 at predetermined time periods. The pulse signals detected by the tachometer 50 are input to the control part 40.

The control part 40 judges S103 whether the drum 3 has become unbalanced or not, with an unbalance detection program which has been programmed therein. If the drum 3 has been detected as being unbalanced, a balancing operation is performed S104, and if the drum 3 has been detected as being balanced, the dehydrating operation is performed S105.

The balancing operation is performed by rotating the drum 3 in bilateral rotational directions alternately. Then, the laundry in the drum 3 is distributed evenly, hence the drum 3 becomes balanced. After the balancing operation, the above-described process is repeated.

However, in such a conventional method for detecting an unbalanced drum in a drum type washing machine, the control part 40 must accumulate the pulse signals during a predetermined time period in order to detect the unbalance, so the time required in detecting the unbalance is long. Furthermore, in order to detect an unbalanced drum on the basis of the accumulated pulse signals, an additional unbalance detection program has to be provided, and a lot of time is additionally consumed in performing such unbalance detection program. Therefore, the dehydrating operation and the balancing operation cannot be completed in a short time, and the time consumed for the operation of the washing machine is lengthened.

SUMMARY OF THE INVENTION

The present invention has been proposed to overcome the above described problems in the prior art, and accordingly it is an object of the present invention to provide a method for detecting an unbalanced drum in a drum type washing machine, which is capable of detecting the unbalance of the drum in a short time.

To achieve the above object, the present invention provides a method for detecting an unbalanced drum in a drum type washing machine comprising the steps of: rotating the drum; gauging number of revolutions of the drum; calculating a deviation of the number of revolutions; and judging unbalance of the drum on the basis of the deviation.

In the step of judging, the drum is judged to be balanced when the deviation is smaller than a predetermined balance criterion, and judged to be unbalanced when the deviation is greater than a predetermined unbalance criterion.

Preferably, the balance criterion is set to 3 rpm and the unbalance criterion is set to 10 rpm.

Furthermore, the steps of gauging and calculating are repeated when the deviation is between the balance criterion and the unbalance criterion.

The deviation can be calculated by a difference between a maximum number of revolutions and a minimum number of revolutions of the drum.

According to the present invention, the pulse signals of the tachometer need not be accumulated over a long time, and an additional unbalance detection program need not be provided and performed, whereby the unbalanced drum can be detected in a short period of time.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
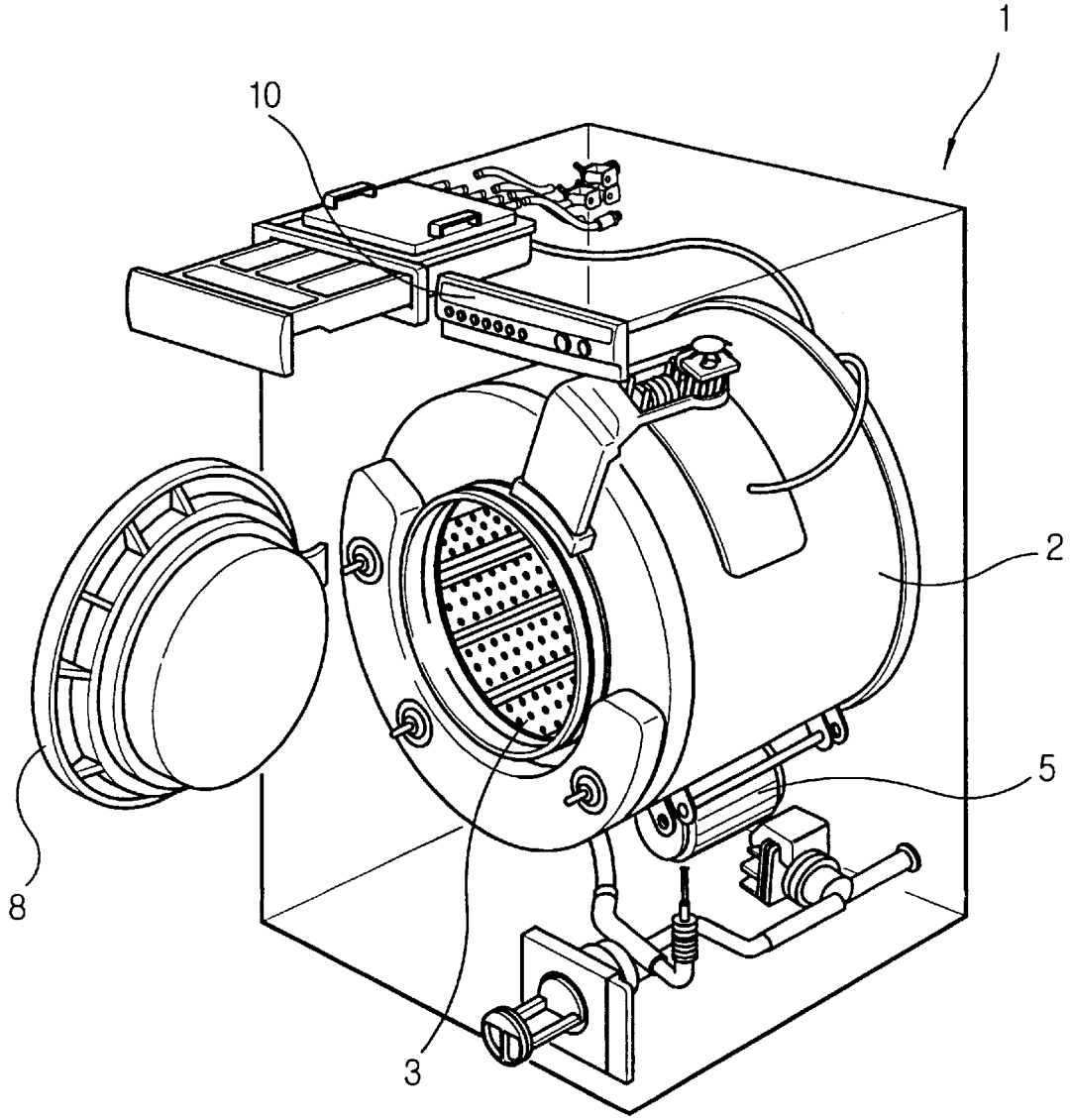
FIG. 1 (PRIOR ART)
FIG. 1 is a perspective view of a conventional drum type washing machine.
Figure 2:
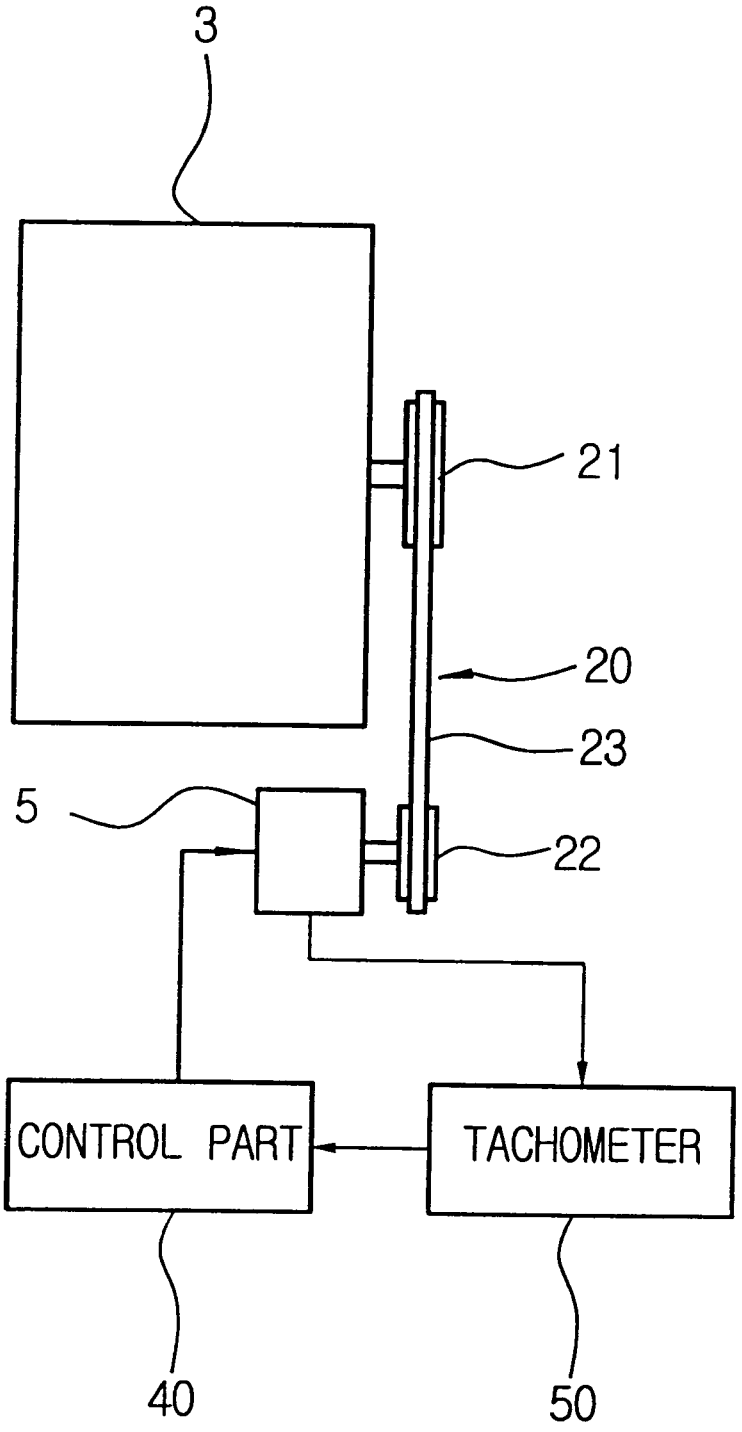
FIG. 2 (PRIOR ART)
FIG. 2 is a schematic view for showing a device for detecting an unbalanced drum in a drum type washing machine shown in FIG. 1.
Figure 3:
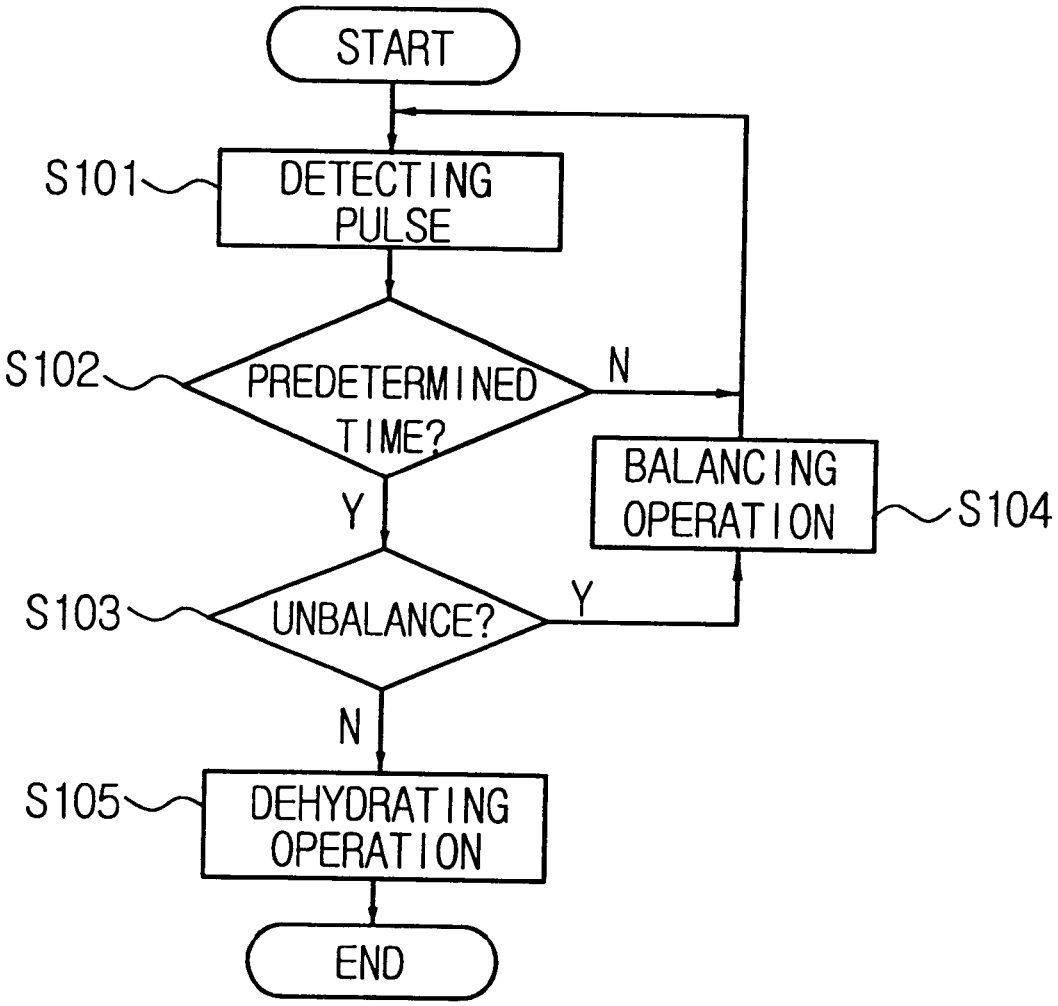
FIG. 3 (PRIOR ART)
FIG. 3 is a flow chart for showing a conventional method for detecting an unbalanced drum in the drum type washing machine.

Hereinafter, the present invention will be described in detail with reference to the drawings. Parts identical to those in the conventional washing machine shown in FIG. 1 will not be described, and will be referred to with the same reference numerals.

Figure 4:
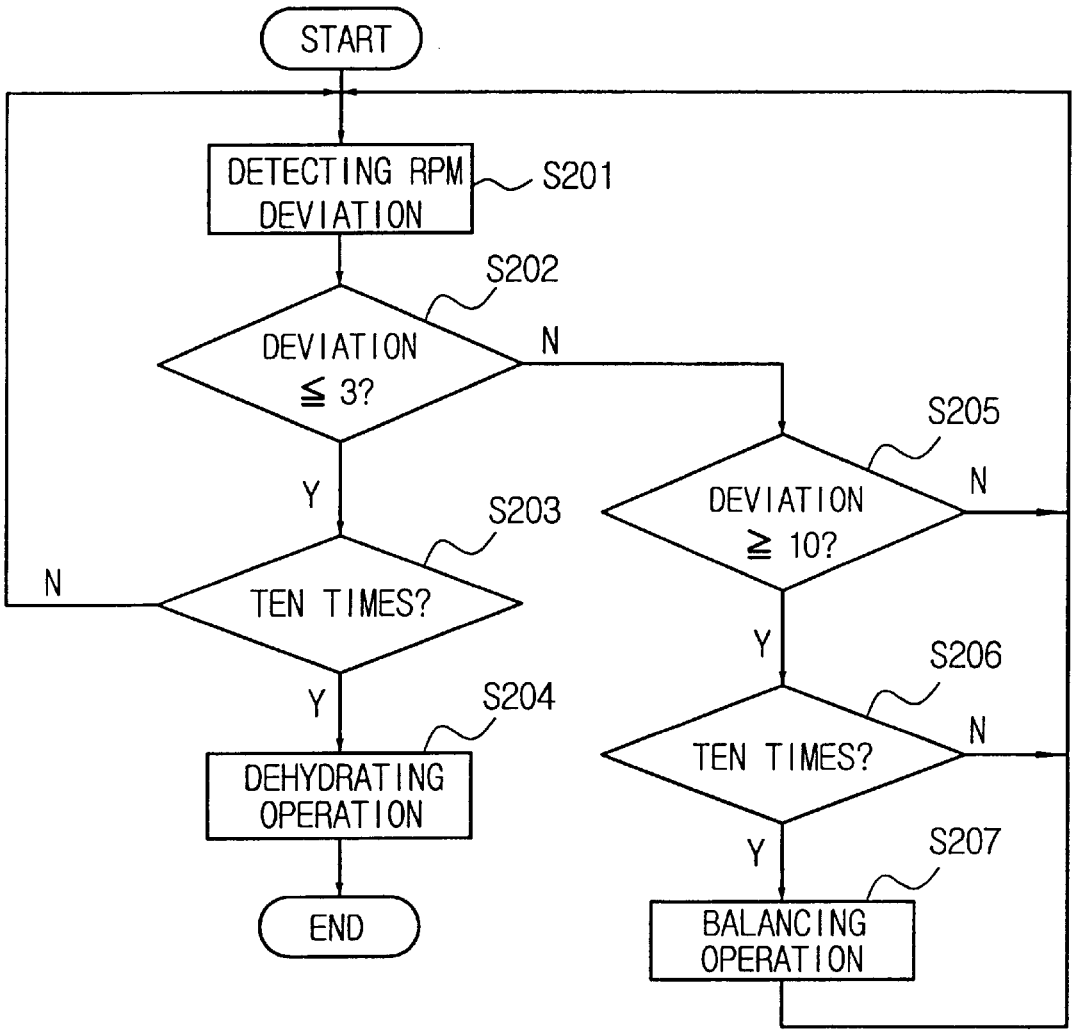
FIG. 4 is a flow chart for showing a method for detecting an unbalanced drum according to the present invention.

FIG. 4 is a flow chart for showing a method for detecting an unbalanced drum according to the present invention.

When the washing operation has been completed, the control part 40 drives the driving motor 5 to rotate the drum 3. In such a situation, the number of revolutions of the drum 3 is changed according to the degree of the uneven distribution of the laundry accommodated in the drum 3. The tachometer 50 detects S201 the deviation of the number of the revolutions of the drum 3. The deviation is preferably calculated by the difference between a maximum number of revolutions and a minimum number of revolutions of the drum 3.

If the deviation is smaller than a predetermined balance criterion S202, the control part 40 judges that the unbalance of the drum 3 does not occur. Such a process is repeated S203 ten times in order to enhance the reliability of the judgement. The balance criterion is preferably set to 3 rpm. If the unbalance is not detected during the ten repetitions of the above process, the dehydrating operation S204 is performed.

If the deviation is greater than 3 rpm, the control part 40 compares S205 the deviation with a predetermined unbalance criterion. If the deviation is smaller than the unbalance criterion, the first step S201 is performed again, and if it is greater than the unbalance criterion, the control part 40 judges that the drum 3 has become unbalanced. In order to enhance the reliability of the judgement, such a process is repeated S206 ten times. The unbalance criterion is preferably set to 10 rpm. If the unbalance is still detected during the ten repetitions of the above process, the balancing operation S207 is then performed.

The balancing operation S207 is performed by driving the drum 3 in bilateral rotational directions alternately as described above. Then, the laundry in the drum 3 is distributed evenly in the drum 3, hence the drum 3 becomes balanced. After the balancing operation S207, the above-described process is repeated.

The present embodiment shows the example that the balance criterion and the unbalance criterion are 3 rpm and 10 rpm respectively, however, such values may be different according to the kind of the drum type washing machine, and preferably are determined experimentally.

Furthermore, in the present embodiment, the process for comparing the deviation of the number of revolutions is repeated ten times, however, such a number of repetitions can be set to be smaller in order to shorten the time consumed in performing the method for detecting the unbalance, or set to be greater in order to enhance the reliability of detection. Furthermore, the detection process can be performed continuously throughout the dehydrating operation.

As described above, according to the present invention, the pulse signals of the tachometer need not be accumulated over a long period of time, and the additional unbalance detection program need not be provided and performed, whereby the unbalance of the drum can be detected over a short period of time.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A method for detecting an unbalanced drum in a drum type washing machine comprising the steps of:

rotating said drum;

gauging a rotary velocity of said drum;

calculating a deviation of the rotary velocity by determining a difference between a maximum rotary velocity and a minimum rotary velocity; and judging unbalance of said drum on the basis of the deviation.

2. The method for detecting an unbalanced drum as claimed in claim 1, wherein said drum is judged to be balanced when the deviation is smaller than a predetermined balance criterion.

3. The method for detecting an unbalanced drum as claimed in claim 2, wherein said balance criterion is 3 rpm.

4. The method for detecting an unbalanced drum as claimed in claim 2, wherein said drum is judged to be unbalanced when the deviation is greater than a predetermined unbalance criterion.

5. The method for detecting an unbalanced drum as claimed in claim 4, wherein said unbalance criterion is 10 rpm.

6. The method for detecting an unbalanced drum as claimed in claim 4, wherein the steps of gauging and calculating are repeated when the deviation is between said balance criterion and said unbalance criterion.

7. The method for detecting an unbalanced drum as claimed in claim 1, wherein the steps of gauging and calculating are repeatedly performed.

* * * * *